US010352642B1

(12) United States Patent
Lee

(10) Patent No.: US 10,352,642 B1
(45) **Date of Patent: *Jul. 16, 2019**

(54) FIREARM SUPPRESSOR ADAPTER FOR BARRELS HAVING OBSTRUCTIONS

(71) Applicant: Darryl S. Lee, Fort Myers, FL (US)

(72) Inventor: Darryl S. Lee, Fort Myers, FL (US)

(73) Assignee: DBDROP Inc., Fort Myers, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/912,965

(22) Filed: Mar. 6, 2018

Related U.S. Application Data

(63) Continuation of application No. 15/901,219, filed on Feb. 21, 2018, now Pat. No. 10,082,354.

(51) Int. Cl.

| | |
|---|---|
| ***F41A 21/30*** | (2006.01) |
| ***F41A 21/48*** | (2006.01) |
| ***F41A 21/32*** | (2006.01) |

(52) U.S. Cl.
CPC ..... *F41A 21/30* (2013.01); *F41A 21/325* (2013.01); *F41A 21/481* (2013.01)

(58) Field of Classification Search
CPC ..... F41A 21/30; F41A 21/32; F41A 21/325; F41C 27/00; F41C 27/04; F41C 27/06; F41C 27/16; F41C 27/18; F41C 27/20; F41C 27/22
USPC ..... 89/14.2, 14.3, 14.4; 42/1.06, 85, 86
See application file for complete search history.

(56) References Cited

U.S. PATENT DOCUMENTS 10,082,354 B1 * 9/2018 Lee ..... F41A 21/325

* cited by examiner

*Primary Examiner* — Bret Hayes
(74) *Attorney, Agent, or Firm* — Nicholas Pfeifer; Smith & Hopen, P.A.

(57) ABSTRACT

A firearm adapter that attaches a muzzle device, such as a suppressor to a broad range of firearm sizes and shapes. The adapter can securely attach and align a suppressor to a wide range of barrel diameters and profiles, including, those barrels with various obstructions, protrusions and geometries. An embodiment of the device reaches over or around barrel obstructions to securely attach a housing to an anchor on an unobstructed section of the barrel and further compresses an alignment surface against the muzzle to create longitudinal and concentric alignment between the barrel and the suppressor.

20 Claims, 7 Drawing Sheets

FIG. 1
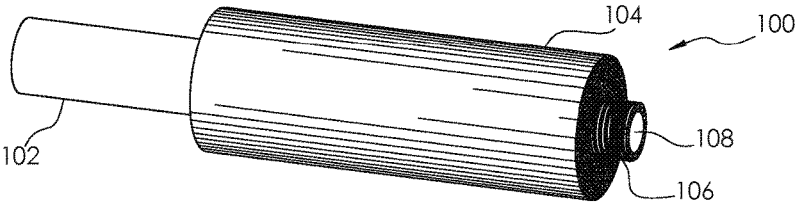
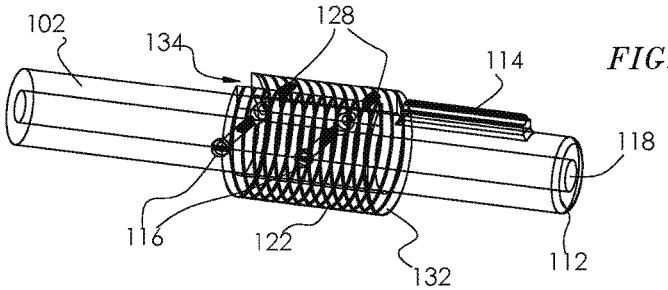
FIG. 2
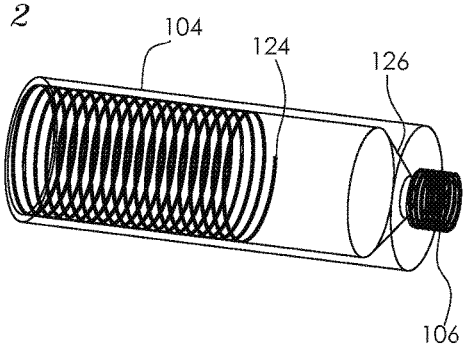
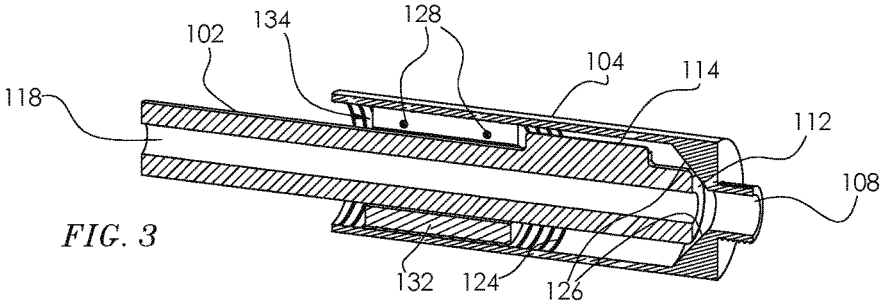
FIG. 3

FIG. 4
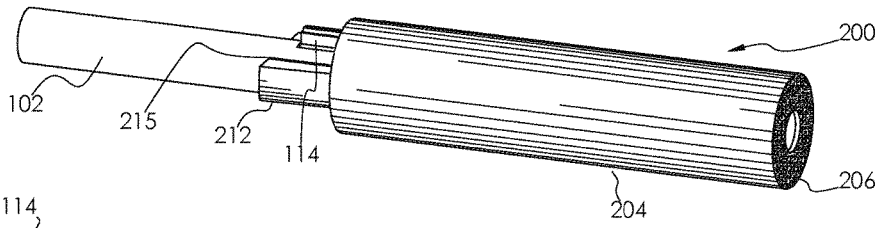
FIG 5
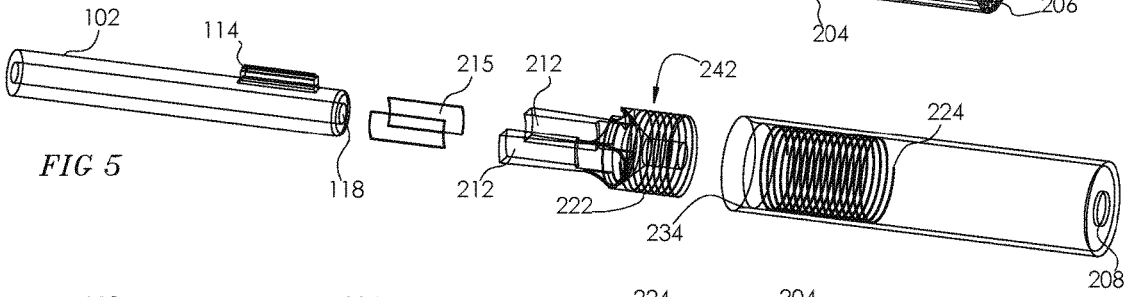
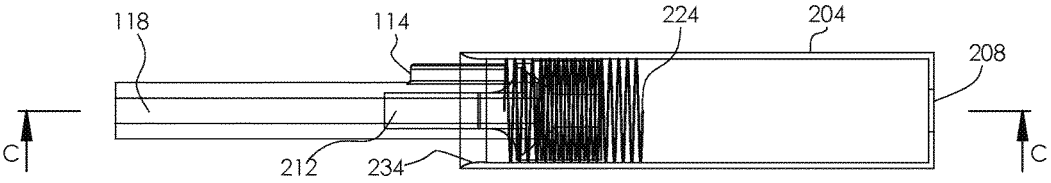
FIG. 6
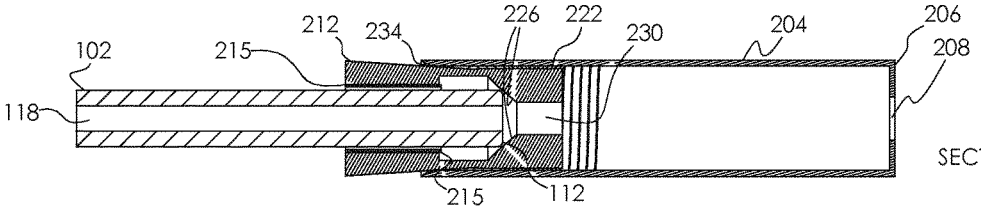
FIG. 7
SECTION C-C

FIG. 11
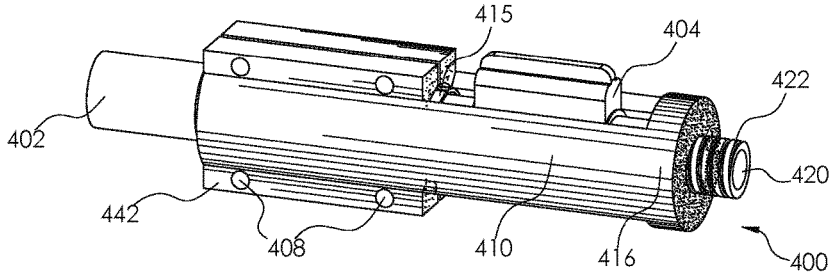
FIG. 12
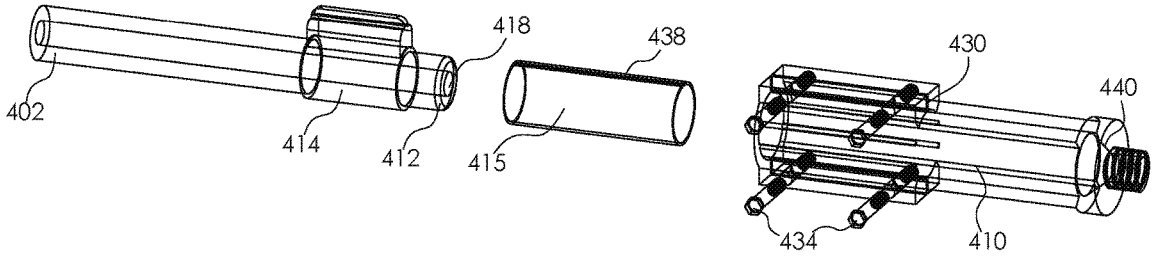
FIG. 13
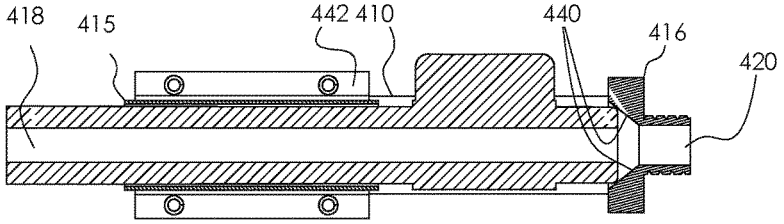
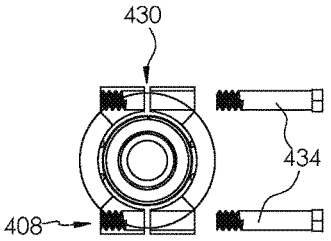
FIG. 14

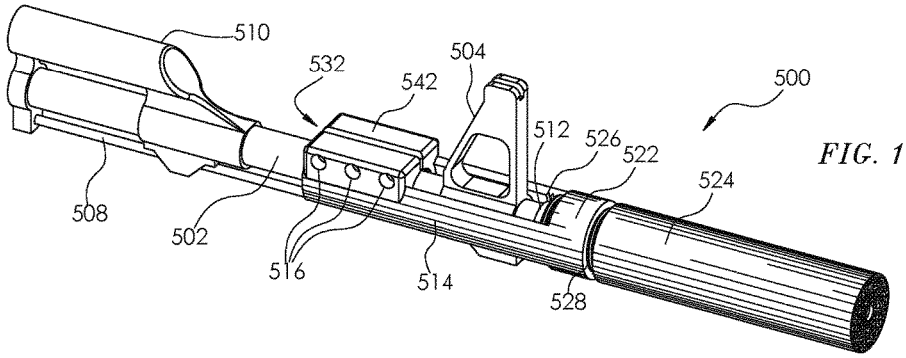
FIG. 15
FIG. 16
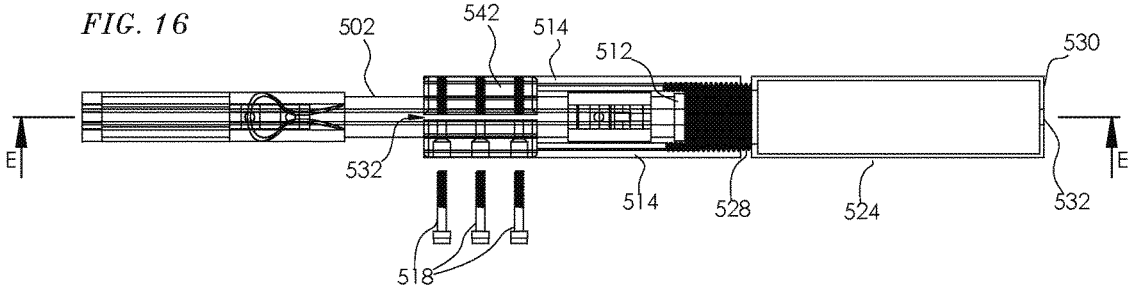

FIG. 19
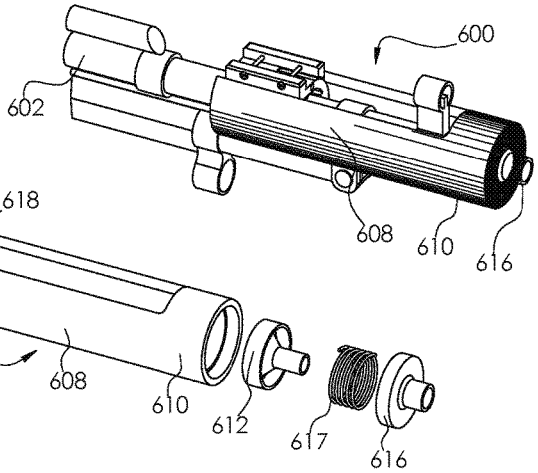
FIG. 20
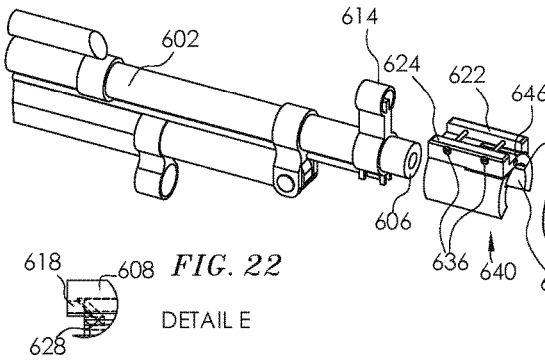
FIG. 22
FIG. 21
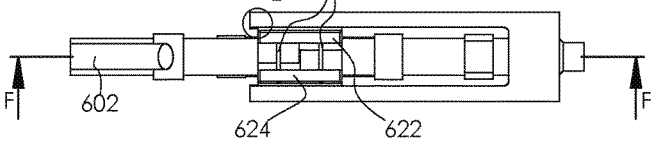
FIG. 23
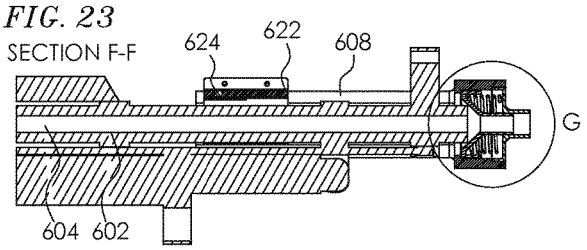
FIG. 24
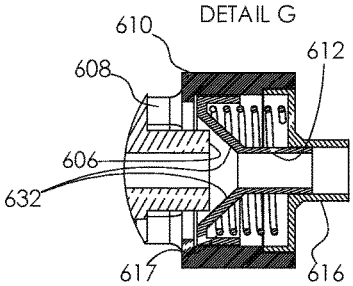

FIREARM SUPPRESSOR ADAPTER FOR BARRELS HAVING OBSTRUCTIONS

CROSS-REFERENCE TO RELATED APPLICATIONS

This nonprovisional application is a continuation of and claims priority to nonprovisional application Ser. No. 15/901,219, entitled "FIREARM SUPPRESSOR ADAPTER FOR BARRELS HAVING OBSTRUCTIONS," filed Feb. 21, 2018 by the same inventor.

BACKGROUND OF THE INVENTION

1. Field of the Invention

This invention relates, generally, to firearms suppressors. More specifically, it relates to a universal adapter for firearm suppressors configured to attach to barrels having obstructions thereon.

2. Brief Description of the Prior Art

Most gunfire produce sound that exceeds 140 dB, which can cause immediate and irreparable hearing loss to the gun operator and also significantly contributes to sound pollution. The effects of gun-fire noise are evidenced by the prevalence of hearing damage among veterans, law enforcement, and older individuals that have been around unsuppressed gunfire. Fortunately, suppressors generally reduce the sound of gunfire by 20 to 25 dB on average, reducing the sound to safe levels for the shooter.

For this reason, suppressors are gaining popularity. In some instances, having recognized the damaging effects of unsuppressed gunfire, the military and various law enforcement agencies are making suppressors available to those personnel that are exposed to gunfire. The anticipated resulting reduction in hearing damage from increased suppressor use is not only beneficial to the individual shooter and those around them, but it also provides a societal beneficial by reducing healthcare cost associated with hearing loss.

Up to now, most firearms were manufactured without the thought of or ability to accept a suppressor. Many barrels were made with obstructions, protrusions and profiles that are not conducive to attaching a suppressor to the barrel. In addition, most barrels were made without the necessary cut and thread profile needed to install modern suppressors. Attaching a suppressor to a firearm with a profile that was other than round involved primitive set screw attachment, non-aligned compression or attaching the adapter to the obstruction itself via a single, non-centerline attachment point.

All the current methods have drawbacks and problems that prevent the respective adapters from being widely adopted. In addition, most adapters do not account for obstructions on the firearm barrel. There are millions of firearms that have some sort of obstruction or abnormal profile at the distal end of the barrel. Some are minor as in the case of an iron sight. Some are much more complex like a large bore revolver or the popular surplus guns like the AK-47 and SKS. It is currently close to impossible to fit a suppressor to a large bore revolver with a common profile without the original manufacturer putting threads on the end of the barrel during manufacture.

Accordingly, what is needed is a firearm adapter that can attach to a firearm barrel having an obstruction, is easy-to-use, and can quickly, accurately, securely, and concentrically attach a suppressor or suppressor extension to the barrel of a firearm. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an easy-to-use, adapter that can quickly, accurately, securely, and concentrically attach a suppressor or suppressor extension to the barrel of a variety of firearms is now met by a new, useful, and nonobvious invention.

In an embodiment, the novel structure includes an anchor that can be secured to a firearm barrel and an outer sheath that can reach around barrel obstructions and connect to the anchor. The anchor includes a length extending between a proximal end and a distal end with a longitudinal axis extending parallel to the length. The anchor further includes an outer lateral surface and an inner lateral surface, wherein the outer lateral surface includes threads. A gap extends at least partially along the length of the anchor and passes through both the inner and outer lateral surfaces, such that a portion of the anchor has a semicircular cross-section with respect to the longitudinal axis. At least a section of the inner lateral surface has a radius greater than a radius of the barrel of the firearm when the anchor is attached to the barrel of the firearm and is adapted to attach to a barrel of a firearm in a manner that prevents rotation of the anchor with respect to the barrel of the firearm.

At least a section of the outer lateral surface of the anchor has a radius greater than the sum of the radius of the barrel of the firearm and a lateral extending distance of any barrel obstruction residing at least partially between a proximal end of the anchor and a distal end of the firearm barrel when the anchor is attached to the barrel of the firearm. In other words, the anchor extends laterally beyond any barrel obstructions.

The outer sheath also has a length extending parallel to a longitudinal axis and an outer lateral surface and an inner lateral surface. The inner lateral surface has a circular cross-section with respect to the longitudinal axis of the outer sheath and threads configured to engage the threads on the outer lateral surface of the anchor. The distal end of the outer sheath includes a centrally located bore axially aligned with the longitudinal axis of the outer sheath, thereby providing passage for a fired projectile.

An embodiment includes an alignment guide secured within the outer housing. The alignment guide is a generally frustoconical-shaped, being tapered in a distal direction thereby causing the barrel of the firearm to axially align with the longitudinal axis of the outer housing as the barrel of the firearm is forced into the outer housing. Alternatively, an embodiment includes the alignment guide secured within the anchor. Again, the alignment guide has a generally frustoconical shape being tapered in a distal direction, thereby causing the barrel of the firearm to axially align with the longitudinal axis of the anchor as the barrel of the firearm is forced into contact with the anchor.

An embodiment includes a tubular cylindrical suppressor mount secured to the distal end of the outer housing in axial alignment with the longitudinal axis of the outer housing. The suppressor mount includes threads on an outer lateral surface adapted to threadedly engage a firearm suppressor. Alternatively, the suppressor can be directly integrated into the outer housing.

In an embodiment, the anchor is adapted to adjust the radius of the inner lateral surface by adjusting a width of the gap. Moreover, the anchor can attach to the barrel of the firearm via a threaded fastener extending through a fastener aperture on one side of the gap and extending into a threaded fastener receipt on a second side of the gap.

In an embodiment, a pair of proximally extending lever arms are secured to the anchor. The lever arms increase in lateral thickness in a proximal direction. The anchor gap resides between the lever arms. The outer housing has a tapered proximal end configured to apply an inward radial force on the lever arms as the outer housing threadedly engages the anchor and moves in a proximal direction with respect to the anchor. Each of the lever arms preferably has a curved inner surface intended to mate with the curvature of the firearm barrel when the anchor is attached to the firearm barrel.

An embodiment of the invention includes a temporary attachable anchor having a proximal end and a distal end with a length extending therebetween and a longitudinal axis extending parallel to the length. The anchor further includes an outer lateral surface and an inner lateral surface, wherein at least a portion of the inner lateral surface has a semicircular cross-section to mate with a curvature of the firearm barrel.

Two or more arm members are integrated with the anchor or attachable to the anchor. The arm members are laterally separated creating a first receiving area between the arm members for receiving barrel obstructions on the firearm barrel.

The adapter further includes an alignment guide housing integrated with or attachable to distal ends of the arm members. The alignment guide housing has a central longitudinal axis and a threaded suppressor mount aligned with the central longitudinal axis. The threaded suppressor may have threads on the inner lateral surface or the outer lateral surface and are configured to engage a suppressor.

The alignment guide is secured within the alignment guide housing and has a generally frustoconical shape tapered in a distal direction. The tapered shape thereby causes the firearm barrel to axially align with the longitudinal axis of the alignment guide housing as a muzzle end of the firearm barrel is forced into the alignment guide housing. An embodiment may include the alignment guide disposed within the alignment guide housing and a biasing member in mechanical communication with the alignment guide and a distal stop. The biasing member imposes a biasing force on the alignment guide in a proximal direction.

An embodiment includes a gap extending at least partially along the length of the anchor that passes through both the inner and outer lateral surfaces, such that a portion of the anchor has a semicircular cross-section with respect to the longitudinal axis. The inner lateral surface of the anchor thus has an adjustable diameter by adjusting a width of the gap. The anchor attaches to the firearm barrel via a threaded fastener extending through a fastener aperture on one side of the gap and extending into a threaded fastener receipt on a second side of the gap.

An object of the invention is to provide a suppressor adapter configured to fit most firearms on the market including those with barrel obstructions and those that were previously incapable of having a suppressor attached thereto.

An object of the invention is to provide an easy-to-use, adapter that can quickly, accurately, securely, and concentrically attach a suppressor, suppressor extension, or rail attachment to the barrel of a firearm.

It is another object of the invention to provide a suppressor adapter that is far less costly to manufacture due to a one size fits all system, and to eliminate the need to manufacture hundreds of sizes and configurations.

In addition, it is an object of this invention to provide an adapter, which can be secured to or integrated with a suppressor and/or a suppressor extension; and provide an adapter that can attach to one or multiple firearm accessories, including, but not limited to a bipod, an iron sight, a sling mount, a rail for mounting accessories, a hand guard for installation from barrel heat, a forward grip, a flashlight, and a laser.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which:

FIG. 1 is a perspective view of an embodiment of the present invention secured to a firearm barrel.

FIG. 2 is a disassembled wireframe view of an embodiment of the present invention highlighting the internal mechanisms of the adapter.

FIG. 3 is a sectional view of FIG. 1.

FIG. 4 is a perspective view of an embodiment of the present invention secured to a firearm barrel.

FIG. 5 is a disassembled wireframe view of an embodiment of the present invention highlighting the internal mechanisms of the adapter.

FIG. 6 is a wireframe elevation view of the embodiment in FIGS. 4-5.

FIG. 7 is a sectional view of FIG. 6.

FIG. 11 is a perspective view of an embodiment of the present invention secured to a firearm barrel.

FIG. 12 is a disassembled wireframe view of an embodiment of the present invention highlighting the internal mechanisms of the adapter.

FIG. 13 is a sectional view of FIG. 11.

FIG. 14 is an end view of the embodiment depicted in FIG. 11.

FIG. 15 is a perspective view of an embodiment of the present invention secured to a firearm barrel.

FIG. 16 is a wireframe view of an embodiment of the present invention highlighting the internal mechanisms of the adapter.

FIG. 19 is a perspective view of an embodiment of the present invention secured to a firearm barrel.

FIG. 20 is a disassembled view of an embodiment of the present invention highlighting the internal mechanisms of the adapter.

FIG. 21 is top view of FIG. 15.

FIG. 22 is a close-up view of detail E in FIG. 21.

FIG. 23 is a sectional view of FIG. 21.

FIG. 24 is a close-up view of detail G in FIG. 23.

DETAILED DESCRIPTION OF THE INVENTION

Figure 8:
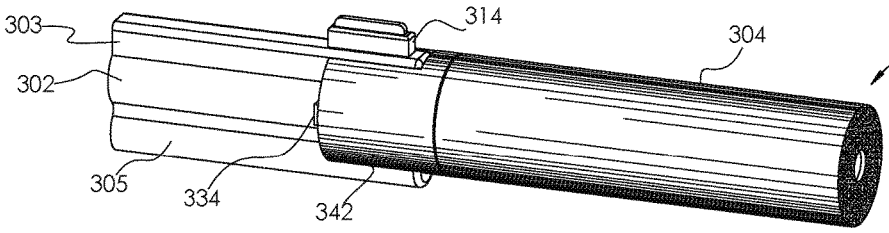
FIG. 8 is a perspective view of an embodiment of the present invention secured to a firearm barrel.

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a firearm adapter configured to reach over and/or around the irregular profile of a firearm barrel and anchor to a smooth unobstructed section of the barrel. The adapter can fit a range of barrel sizes and in most cases, barrel profiles, which is not possible for traditional firearm adapters. The ability of the present invention to attach to a variety of gun barrels reduces the costs associated with manufacturing, packaging, labeling, and stocking because a single adapter of the present invention can replace thousands of different suppressor and rail adapters. Moreover, the present invention allows a suppressor to be attached to barrels previously incapable such an attachment.

The present invention is an improvement over previous devices in which the adapter had to be anchored to the barrel irregularity or obstruction. These barrel parts can include an iron sight, a flash hider, a barrel band and other protrusions, were never meant to accept the pulling force of a suppressor while in use. In the case of attachment to the iron sight, pulling from a single point on an otherwise circular profile can cause a dangerous out of alignment condition at the distal muzzle of the suppressor. A slight misalignment at the anchor point will be magnified over the distance between the anchor point and the suppressor muzzle. In contrast, the present invention reaches past the barrel obstruction or protrusion to attach to an unobstructed section of the barrel or firearm.

Referring now to FIGS. 1-3, an embodiment of firearm adapter 100 is designed to attach to barrel 102 having iron sight 114 near muzzle end 112. Adapter 100 includes anchor 132 having an adjustable gap/slot 134 to slide on and around a barrel obstruction and also give anchor 132 an adjustable inner diameter to fit barrels of various sizes. Each side of slot 134 includes apertures 128 for receiving fasteners 116 which provide the necessary clamping force to tighten anchor 132 to barrel 102. In an embodiment, aperture 128 on one side of slot 134 are threaded to engage a threaded male end of fasteners 116. It is contemplated that any number and any type of fastener known to a person of ordinary skill in the art may be employed to reduce the inner diameter of anchor 132 and secure said anchor to barrel 102. Preferably, the fasteners only engage the anchor to avoid permanently damaging the barrel of the firearm.

Anchor 132 also includes threads 122 on an outer lateral surface. Threads 122 are intended to engage threading 124 on an internal surface of outer housing 104. The thread height/depth is a factor of the intended adjustment of the inner diameter of anchor 132. With proper thread height/depth, anchor 132 can be adjusted to mate to a variety of barrel diameters and still threadedly engage outer housing 104.

Outer housing 104 further includes alignment guide 126 designed to funnel muzzle end 112, and in turn barrel bore 118 into concentric/axial alignment with bore 108 in outer housing 104. The funneling alignment organically occurs as outer housing 104 is rotationally tightened onto anchor 132. Anchor 132 is fixed along the longitudinal axis of the barrel and the threaded engagement cause outer housing 104 to move in a linear direction (along the longitudinal axis of barrel 102) as outer housing 104 is rotated with respect to anchor 132. As outer housing 104 moves proximally (towards the handle of the firearm, i.e. a direction away from the muzzle end) the muzzle end 112 comes into contact with alignment guide 126 and the tapered slope forces outer housing 104 to axially align with barrel 102.

Alignment guide 126 also creates a seal with muzzle 112. In an embodiment, alignment guide 126 may include a compressible material to further enhance the seal between the alignment guide 126 and muzzle 112. Ultimately, the seal prevents the hot gasses leaving barrel bore 118 from traveling back towards the firearm operator and forces all of the gasses into the suppressor secured to the distal end of outer housing 104.

The distal end of outer housing 104 includes a threaded suppressor mount 106 configured to threadedly engage a suppressor. Mount 106 is axially aligned with the longitudinal axis of outer housing 104 to ensure that bore 108 axially aligns with barrel bore 118 when adapter 100 is secured to firearm barrel 102. In an embodiment, suppressor mount 106 may attach to a suppressor via any fastening methods known to a person having ordinary skill in the art. In addition, an embodiment may include the suppressor directly integrated into outer housing 104.

As depicted in FIG. 3, the inner radius of outer housing 104 must be greater than the outer radius of firearm barrel 102 plus the height of iron sights 114. The length of outer housing 104 must also be at least as long as the distance from a smooth section of barrel 102, that is proximally located with respect to the obstruction, to muzzle end 112. Essentially, housing 104 reaches around and behind obstruction 114 to threadedly engage anchor 132. It should be noted that while the exemplary figures depict a barrel obstruction in the form of iron sights 114, the present invention is designed to account for any type of obstruction. The adapter, however, can also be used on barrels without obstructions.

In an embodiment, outer housing 104 may engage anchor 132 using a fastening method other than threads, so long as the outer housing 104 can engage anchor 132 at any point along their respective longitudinal axes. For example, outer housing 104 may use a cam locking fastener to clamp around anchor 132. In addition, anchor 132 and outer housing 104 may remain secured to barrel 102 even when the suppressor is not in use.

Referring now to FIGS. 4-7, an embodiment of the adapter, generally denoted by reference numeral 200, includes anchor 242 configured to compress around barrel 102 as outer housing 204 translates proximally along the longitudinal axis of anchor 242 and engages lever arms 212. As depicted, outer housing 204 is actually a suppressor with the internal baffles (not shown). In an embodiment, the suppressor can mount to outer housing 204 rather than be directly integrated as depicted by the exemplary illustrations in FIGS. 4-7.

Outer housing 204 further includes a distal end with a centrally located aperture 208 through which a projectile travels when fired. Near the proximal end, outer housing 204 includes threads 224 designed to engage threading 222 on anchor 242. The proximal end of outer housing 204 further includes tapered compression surface 234 intended to contact and compress lever arms 212 as outer housing 204 moves in the proximal direction with respect to anchor 242.

As previously noted, adapter 200 includes anchor 242 designed to compressively engage barrel 102. This compression engagement is accomplished via two or more lever arms 212, each having a tapered design such that the width in the radial direction is increases in a direction moving from the distal end to the proximal end of each lever arm 212. Thus, outer housing 204 causes lever arms 212 to compress inwardly in a radial direction as outer housing 204 moves in a proximal direction and moves along the outer surfaces of lever arms 212.

As depicted in FIGS. 4-7, anchor 242 includes two lever arms 212, designed to flex in a radial direction, in a diametrically opposed relationship. It is considered, however, that more than two lever arms may be used, so long as the lever arms are generally equidistantly spaced about the circumference of anchor 242, thereby ensuring that anchor 242 maintains a concentric axial alignment with barrel 102 when anchor 242 is compressively secured to barrel 102. In addition, the number and size of lever arms 212 is dependent on the size and locations of barrel obstructions 114. The exemplary barrel obstruction as depicted is an iron sight, but any type of obstruction is considered.

FIGS. 4-7 also depict the use of fitment inserts 215 designed to reside between barrel 102 and lever arms 212. Fitment inserts 215 are made of a compressible material, such as rubber or another synthetic compressible material, to provide an improved compression fit between anchor 242 and barrel 102. Fitment inserts 215 are also heat resistant to avoid melting as a result of barrel heating while firing. The number and size of fitment inserts 215 are dependent on the number and size of lever arms 212. Fitment inserts 215 can also have certain thicknesses to help fit adapter 200 to barrels of various sizes. Furthermore, fitment inserts 215 may further provide a secure gripping surface using e.g., grooves, ridges, or slits, on an outer surface and/or inner surface of inserts 215, for a more secure attachment of the anchor to a smooth metallic gun barrel. An embodiment of fitment insert 215 may have a flexible tubular structure with a slot extending the entire length of the insert, such that the tubular structure has an incomplete circumference and can be adjusted to fit around barrels of various diameters.

Anchor 242 further includes alignment guide 226 to funnel barrel 102 into axial alignment with bore 230 and ultimately aperture 208 in outer housing 204. As anchor 242 moves proximally (towards the handle of the firearm) the muzzle end 112 comes into contact with alignment guide 226 and the tapered slope forces anchor 242 to axially align with barrel 102. Alignment guide 226 also creates a seal with muzzle 112. In an embodiment, alignment guide 226 may include a compressible material thereon to further enhance the seal between the alignment guide 226 and muzzle 112. Ultimately, the seal prevents the hot gasses leaving barrel bore 118 from traveling back towards the firearm operator and forces all the gasses into the suppressor.

As depicted in FIGS. 6-7, the attachment of adapter 200 on barrel 102 includes anchor 242 axially forced onto the distal end of barrel 102 such that muzzle end 112 contacts alignment guide 226 to force axial alignment between anchor 242 and barrel 102. Fitment inserts 215 are placed between lever arms 212 and barrel 102; and anchor 242 is oriented such that lever arms 212 contact a portion of the distal end of barrel 102 lacking obstructions 114 to help ensure a secure compression of anchor 242 to barrel 102. Outer housing 204 is then rotated into threaded engagement with anchor 242. Compression surface 234 on outer housing 204 forces lever arms 212 inwardly in a radial direction to tighten the compression of lever arms 212 around barrel 102. At a certain point, adapter 200 will be securely attached to barrel 102 and will automatically have axially aligned with firearm bore 118.

In an embodiment, outer housing 204 may engage anchor 242 using a fastening method other than threads, so long as the outer housing 204 can engage anchor 242 at any point along their respective longitudinal axes. For example, outer housing 204 may use a cam locking fastener to clamp around anchor 242.

Figure 9:
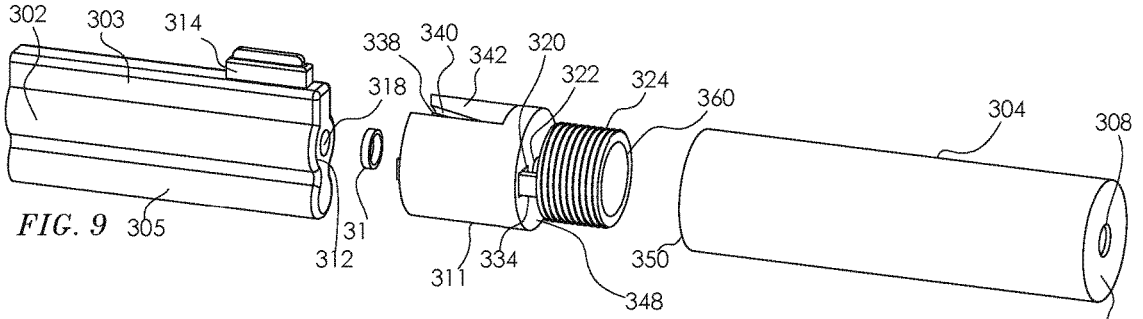
FIG. 9 is a disassembled wireframe view of an embodiment of the present invention highlighting the internal mechanisms of the adapter.
Figure 10:
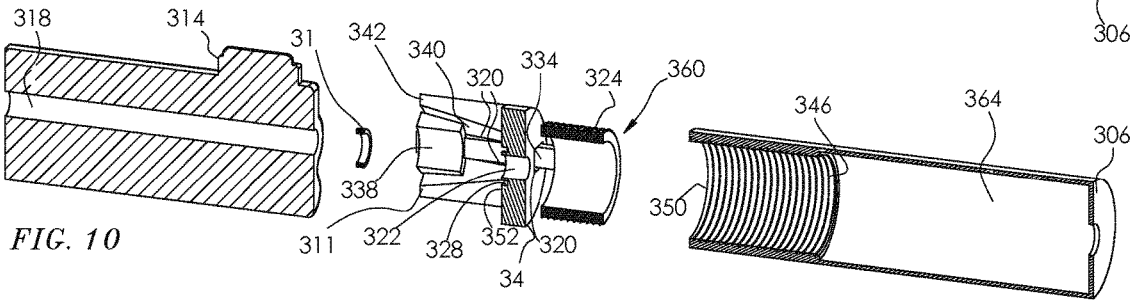
FIG. 10 is a sectional view of the embodiment in FIG. 9.
Figure 17:
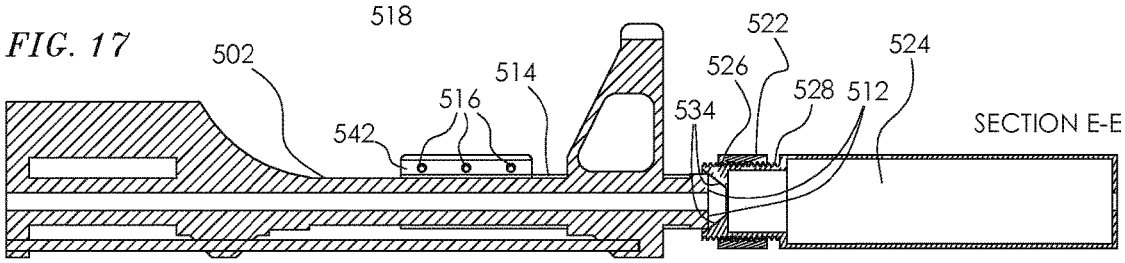
FIG. 17 is a sectional view of FIG. 15.

Referring now to FIGS. 8-10, an embodiment of the adapter, generally denoted by reference numeral 300, includes anchor 342 having two or more wedges 338 for compressively securing adapter 300 to barrel 302. Exemplary barrel 302 is a common profile of a large bore revolver. This profile includes the rounded barrel merged with square upper profile 303, round lower profile 305, and iron sight 314. Historically, suppressors were unable to mount to the oddly shaped large bore revolver. Adapter 300, however, is designed to overcome the distinct obstructions—square upper profile 303, round lower profile 305, and iron sight 314—and ultimately attach a suppressor to a large bore revolver. While, the exemplary barrel is a large bore revolver, adapter 300 may be used with various other barrel shapes.

Anchor 342 is comprised of translation mechanism 360 and stationary component 311. Stationary component 311 includes a tapered inner surface 340 that reduces the inner diameter of stationary component 311 moving in a distal direction. Stationary component 311 further includes wedge alignment channels 320 generally extending the length of stationary component 311 and passing through distal end cap 349. Distal end cap 349 has central axial bore 322 for passage of a projectile and an embodiment includes a grommet channel 328 on interior surface 352 for receiving sealing grommet 319, which is intended to create a seal between muzzle 319 and stationary component 311 to prevent high pressure gases from escaping.

Translation mechanism 360 is distally located from stationary component 311 and includes a pair of arm member 334 extending in a proximal direction. Each arm member 334 passes through and resides within wedge alignment channels 320. Each arm member 334 is attached to a wedge 338. Wedges 338 are diametrically opposed from each other and include a concave inner surface to aid in the axial alignment of anchor 342 with a smooth curved section of barrel 302.

The distal end of translation mechanism 360 includes a hollow cylindrical section with threads 324 on its outer surface. Threads 324 are designed to engage threads 346 on outer housing 304. Rotation of outer housing 306 thus causes translation of translation mechanism 360 about the longitudinal axis of outer housing 304. As translation mechanism 360 is pulled distally into outer housing 304, wedges 338 are also pulled distally along the tapered inner surface 340 causing wedges 338 to compress around barrel 302.

The attachment of adapter 300 to barrel 102 is achieved by forcing muzzle 312 into contact with internal surface 352 and/or sealing grommet 319. Outer housing 304 is then rotated onto threaded section of translation mechanism 360. Outer housing 360 is continually rotated until translation mechanism 360 has pulled wedges 338 sufficiently in a distal direction to create a compression attachment of anchor 342 to barrel 102. The compression fit automatically axially aligns aperture 308 with firearm bore 318.

In exemplary FIGS. 8-10, outer housing 304 is again integrated into a suppressor, which would typically have baffles in section 364, but said baffles are not depicted. Alternatively, outer housing 304 can be detachably coupled to a suppressor via any fastening method known to a person of ordinary skill in the art, such as through a threaded mount similar to the one shown in FIGS. 1-3.

Referring now to FIGS. 11-14, an embodiment of the adapter, generally denoted by reference numeral 400, is designed to reach past and around barrel obstructions and has a single piece construction. It is possible, however, for the various components to be removably attached to each other. As depicted the rearward proximal end of adapter 400 includes anchor portion 442, which includes two halves that can be fastened together. The two-half construction creates gap 430 to allow anchor portion 442 to separate and pass around barrel obstructions, such as banded iron sight 414, when barrel 102 slides into adapter 400. While the proximal end is divided into two halves, it is considered that anchor portion 442 may be divided into any number of parts to create a plurality of gaps 430 through which obstructions may pass.

Anchor 442 further includes one or more fasteners apertures 408 for receiving fasteners 434. Fasteners 434 secure the two halves of anchor portion 442 together and act to clamp the two halves around barrel 102. One of the halves may include threads on the internal surface of fastener apertures 434 that are designed to engage threads on the end of fastener 434. Fasteners 434 are depicted as screws, but any type of fastener may be used to force the two halves of anchor portion 442 together to clamp anchor 442 around barrel 102.

The internal surfaces of each half are also curved to mate with the curved surface of the barrel. The curvature ensures proper concentric alignment when clamping around barrel 102. An embodiment may include fitment insert 415. Fitment insert 415 has a flexible tubular structure with slot 438 extending the entire length of the insert, such that the tubular structure has an incomplete circumference and can be adjusted to fit around barrels of various diameters and their respective obstructions 414. Fitment insert 415 is designed to reside between barrel 402 and anchor portion 442 to allow for greater compression forces on the barrel, account for barrels of varying sizes, and improve the gription of the anchor on the barrel. Fitment insert 415 is preferably made of a compressible material, such as rubber or another compressible material, to provide an improved compression fit between anchor 442 and barrel 402. Fitment insert 415 is also heat resistant to avoid melting as a result of the barrel heating during operation of the firearm. Fitment insert 415 can be specifically made at different thicknesses to help fit adapter 400 to barrels of various sizes. Furthermore, fitment insert 415 may include a secure gripping surface using e.g., grooves, ridges, or slits, on an outer surface and/or inner surface of insert 415, for a more secure attachment of the anchor to a smooth metallic gun barrel. An embodiment of fitment insert 415 may include a plurality of semicircular pieces rather than a tubular shape with a slot extending the length of the insert.

Anchor portion 442 is attached to alignment guide housing 416 via two arms members 410. Arm members 410 are generally semicircular, but can be any general shape, and have some degree of flexibility to allow gap 430 in anchor portion 442 to expand as need for various barrel obstructions. The number, size, and location of arm members 410 can vary depending on the profile of the firearm barrel on which adapter 400 is intended to be mounted.

Alignment guide housing 416 includes alignment guide 440 with a tapered inner surface for receiving muzzle end 412 of barrel 402. As adapter 400 moves proximally (towards the handle of the firearm) the muzzle end 412 comes into contact with alignment guide 440 and the tapered slope forces adapter 400 to axially align with barrel 402. Alignment guide 440 also creates a seal with muzzle 412. In an embodiment, alignment guide 440 may include a compressible material thereon to further enhance the seal between the alignment guide 440 and muzzle 412. Ultimately, the seal prevents the hot gasses leaving barrel bore 418 from traveling back towards the firearm operator and forces all of the gasses into the suppressor.

The distal end of alignment guide housing 416 includes suppressor mount 422, which includes projectile bore 420 and threads on its outer surface. A suppressor, not shown, can be mounted on threaded suppressor mount 422 using the threads, or mount 422 can employ another fastening method as known to a person of ordinary skill in the art. Moreover, adapter 400 can remain secured to barrel 402 when a suppressor is not in use. Alternatively, an embodiment may include the suppressor directly integrated into the distal end of adapter 400.

Figure 18:
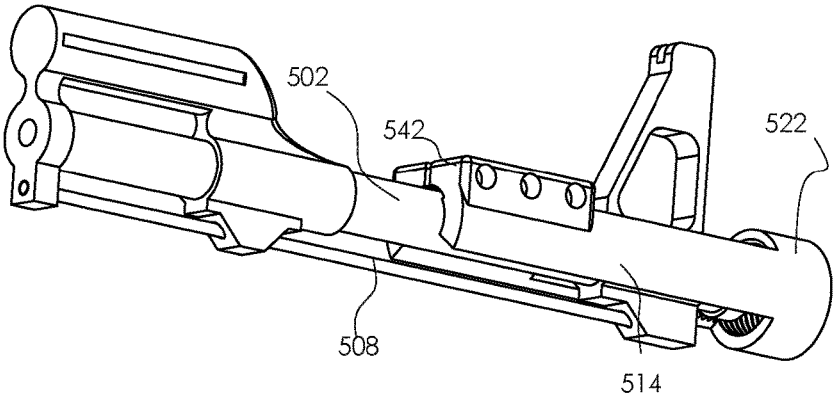
FIG. 18 is a bottom perspective view of FIG. 15.

Referring now to FIGS. 15-18, adapter embodiment 500, having a similar construction as embodiment 400, includes anchor portion 542 having fastener apertures 516 located on only an upper end of anchor portion 542. Fasteners 518 are intended to clamp anchor portion 542 to barrel 502 by threadedly engaging fastener apertures 516 having internal threads. Furthermore, as depicted in FIG. 18, the underside of anchor portion 542 is cut out to account for various barrel obstructions such as cleaning rod 508 typically found on an AK-47. This configuration also allows adapter 500 to drop onto the barrel rather than having to slide onto the barrel, which makes the avoidance of barrel obstructions easier to achieve. It should be noted that an inner surface (the surface that mates with the barrel) of anchor portion 542 has a circumference of at least 180 degrees, to ensure that the anchor portion can securely clamp onto the barrel.

Anchor portion 542 connects to alignment guide housing 522 via two arms members 514. Arm members 514 are generally semicircular, but can be any general shape, and have some degree of flexibility to allow gap 532 in anchor portion 542 to expand as need for various barrel obstructions. The number, size, and location of arm members 514 can vary depending on the profile of the firearm barrel on which adapter 500 is intended to be mounted. As depicted, arms 514 travel along the lateral sides of barrel 502 to avoid AK-style iron sight 504, which extends both above and below barrel 502.

Alignment guide housing 522 includes internal threaded surface 526 adapted to threadedly engage threads 528 on suppressor 524. As depicted best in FIG. 17, suppressor 524 includes alignment guide 534 with a tapered inner surface for receiving muzzle end 512 of barrel 502. As suppressor 524 is threaded into alignment guide housing 522, which has been previously secured along the longitudinal axis of barrel 502 via anchor 542, suppressor 524 translates linearly in a proximal direction (towards the handle of the firearm) causing muzzle end 512 to contact alignment guide 534. The tapered slope of alignment guide 534 forces adapter 500 and suppressor 524 to axially align with barrel 502.

Alignment guide 534 also creates a seal with muzzle 512. In an embodiment, alignment guide 534 may include a compressible material thereon to further enhance the seal between the alignment guide 534 and muzzle 512. Ultimately, the seal prevents the hot gasses leaving the barrel bore from traveling back towards the firearm operator and forces all of the gasses into suppressor 524.

As depicted, suppressor 524 is integrated with alignment guide 534, however, it is considered that suppressor 524 may be a separate part configured to mount to a suppressor mount secured to the distal end of alignment guide 534, similar to mount 106 in FIG. 1.

Adapter 500 may also use a fitment insert (not shown) similar to the fitment insert 415 to achieve the same desired effects.

Referring now to FIGS. 19-24, an embodiment of the adapter, generally denoted by reference numeral 600, includes a generally C-shaped anchor 640 adapted to clamp down on at least half of the circumference of barrel 602. Barrel 602 is a common SKS barrel profile, but adapter 600 can be used with any barrel type. Anchor 640 is particularly useful for an SKS barrel 602 because it includes barrel obstructions on the underside of barrel 602. C-shaped anchor 640 has the necessary shape to clamp onto barrel 602 while avoiding these obstructions and still creating an axial alignment between anchor 640 and barrel 602.

As depicted, adapter 600 includes an anchor 640 that is independent from alignment guide 612 and arm members 608. Interior surfaces 620 of anchor 640 are curved to mate with the curved outer surface of barrel 602 and an embodiment also include cutout 613 across the top of interior surface 620 to allow for clearance over irregular upper barrel profiles, like in the case of the square upper profile on the revolver in FIGS. 8-10. Anchor 640 is compressively secured to barrel 602, using for example, upper lever structures 622, 624, which alter the distance between the two halves of C-shaped anchor via pivot pin 646 and fasteners 636. It is consider, however, that anchor 640 may be secured to barrel 602 using any fastening techniques know to a person of ordinary skill in the art.

Outer housing 642 includes a pair of arm members 608 extending from alignment housing guide 610. Arm members 608 create upper and lower cavities intended to accept barrel obstructions. Outer housing 642 reaches around and past the barrel obstructions and receives anchor 640 when slid onto barrel 602. The proximal end of outer housing 618/arm members 608 include inwardly projecting protrusions 618 adapted to engage receipts 628 on the proximal ends of anchor 640 as best depicted in FIG. 22. Protrusions 618 and receipts 628 may have any size and shape so long as protrusions 618 can be received by receipts 628. This interaction helps to align the proximal end of outer housing 642. The distal end of outer housing 642 axially aligns with barrel 602 via the alignment guide 612, which attaches to outer housing 640 at alignment guide housing 610.

Alignment guide 612 includes a central bore and tapered inner surfaces 632 to funnel muzzle end 606 into axial alignment with alignment guide 612. As depicted in FIGS. 20, 23, and 24, alignment guide 612 is in mechanical communication with spring 617, which is in mechanical communication with end cap 616. End cap 616 is secured to alignment guide housing 610, while spring 617 is free to impart a linear force on alignment guide 612 in an axial direction. The spring-based alignment guide improves upon the alignment and sealing ability between the alignment guide and the muzzle.

In an embodiment, alignment guide 612 may include a compressible material thereon to further enhance the seal between the alignment guide 612 and muzzle 632. Ultimately, the seal prevents the hot gasses leaving the barrel bore from traveling back towards the firearm operator and forces all of the gasses into the suppressor.

End cap 616 further includes a central bore for passage of the projectile and preferably includes threads (not shown) on which a suppressor may be mounted. Alternatively, the suppressor may be directly integrated with end cap 616 or any other part of outer housing 608. In addition, a suppressor may be mounted to end cap 616 according to any methods know to a person of ordinary skill in the art.

Regardless of the embodiment, each of the adapters is configured to automatically align the barrel of a firearm with a suppressor. Furthermore, the anchoring portions of each adapter may be secured to the barrel of a firearm according to any methods known to a person of ordinary skill in the art and preferably remain detachable from said firearm.

As depicted in each exemplary image, the adapters are generally cylindrical in shape, but may have any shape that allows the anchor to be secured to be secured to the barrel of a firearm while also axially aligning with the barrel of the firearm.

While the different exemplary images show several distinct barrels, each adapter may be used with various barrels, including those with and without barrel obstructions. Moreover, barrel obstructions generally include any features on or near the barrel of a firearm that results in a non-circular cross-section of the barrel.

Each of the embodiments of the adapter may be used with a fitment insert or sleeve. The fitment inserts provide an inexpensive and highly variable means for fitting a single size adapter to most firearms without having to modify the firearm barrel. A tapered fitment sleeve may also be used on tapered barrels to effectively create a non-tapered barrel.

Glossary of Claim Terms

Barrel Obstruction: is a structural element of a firearm barrel that diverts the barrel's cross-section from a typical circular shape.

Lateral Extension: is an extension of an obstruction in a radial direction with respect to the barrel of the firearm.

Seal: is a device or substance that is used to join two things together to prevent them from coming apart or to prevent anything from passing between them.

Tubular: means having the form or shape of a hollow, elongated body.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An adapter for a firearm, comprising:

an anchor adapted to be temporarily secured to a firearm barrel, the anchor including:

a proximal end and a distal end with a length extending therebetween and a longitudinal axis extending parallel to the length;

an outer surface and an inner surface, wherein at least a portion of the inner surface has a semi-circular cross-section to mate with a curvature of the firearm barrel;

two or more arm members integrated with the anchor or attachable to the anchor, the arm members laterally separated creating a first receiving area between the arm members for receiving barrel obstructions on the firearm barrel; and an alignment guide housing integrated with or attachable to distal ends of the arm members, the alignment guide housing further including a central longitudinal axis and a threaded mount aligned with the central longitudinal axis.

2. The adapter of claim 1, further comprising an alignment guide secured within the alignment guide housing, the alignment guide including a generally frustoconical shape being tapered in a distal direction, thereby causing the firearm barrel to axially align with the longitudinal axis of the alignment guide housing as a muzzle end of the firearm barrel is forced into the alignment guide housing.

3. The adapter of claim 1, wherein the threads on the threaded mount are located on an outer surface.

4. The adapter of claim 1, wherein the threads on the threaded mount are located on an inner surface.

5. The adapter of claim 1, further comprising:

an alignment guide disposed within the alignment guide housing, the alignment guide including a generally frustoconical shape being tapered in a distal direction, thereby causing the firearm barrel to axially align with the longitudinal axis of the alignment guide housing as a muzzle end of the firearm barrel is forced into the alignment guide housing; and a biasing member in mechanical communication with the alignment guide and a distal stop, the biasing member imposing a biasing force on the alignment guide in a proximal direction.

6. The adapter of claim 1, further comprising a gap extending at least partially along the length of the anchor and passing through both the inner and outer surfaces, such that a portion of the anchor has a semicircular cross-section with respect to the longitudinal axis.

7. The adapter of claim 6, further comprising the inner surface of the anchor having an adjustable diameter by adjusting a width of the gap.

8. The adapter of claim 7, further comprising the anchor attaching to the firearm barrel via a threaded fastener extending through a fastener aperture on one side of the gap and extending into a threaded fastener receipt on a second side of the gap.

9. The adapter of claim 1, further comprising a suppressor directly integrated into the alignment guide housing.

10. The adapter of claim 1, wherein the anchor comprises at least one fastener, whereby actuating the fastener reduces a size of an open barrel receiving space in the anchor.

11. The adapter of claim 1, further comprising the two or more arms arranged such that there is a second receiving space that is diametrically opposed from the first receiving space.

12. The adapter of claim 1, further comprising the two or more arms each having curved inner surfaces.

13. An adapter for a firearm, comprising:

an anchor adapted to be temporarily secured to a firearm barrel, the anchor including:

a proximal end and a distal end with a length extending therebetween and a longitudinal axis extending parallel to the length;

an outer surface and an inner surface, wherein the inner surface creates an open barrel receiving space and at least a portion of the inner surface has a generally semi-circular cross-section to mate with a curvature of the firearm barrel;

a fastener mechanically attachable to the anchor, whereby actuating the fastener reduces the size of the open barrel receiving space in the anchor;

two arm members integrated with the anchor or attachable to the anchor and extending distally from the anchor, the arm members laterally separated creating a first receiving area between the arm members for receiving barrel obstructions on the firearm barrel; and an alignment guide housing integrated with or attachable to distal ends of the arm members, the alignment guide housing further including a central longitudinal axis and a mount aligned with the central longitudinal axis, wherein the mount includes a projectile aperture axially aligned with the barrel of the firearm.

14. The adapter of claim 13, further comprising an alignment guide secured within the alignment guide housing, the alignment guide including a generally frustoconical shape being tapered in a distal direction, thereby causing the firearm barrel to axially align with the longitudinal axis of the alignment guide housing as a muzzle end of the firearm barrel is forced into the alignment guide housing.

15. The adapter of claim 13, further including threads on an outer surface of the mount.

16. The adapter of claim 13, further including threads on an inner surface of the mount.

17. The adapter of claim 13, further comprising:

an alignment guide disposed within the alignment guide housing, the alignment guide including a generally frustoconical shape being tapered in a distal direction, thereby causing the firearm barrel to axially align with the longitudinal axis of the alignment guide housing as a muzzle end of the firearm barrel is forced into the alignment guide housing; and a biasing member in mechanical communication with the alignment guide and a distal stop, the biasing member imposing a biasing force on the alignment guide in a proximal direction.

18. The adapter of claim 13, further comprising a gap extending at least partially along the length of the anchor and passing through both the inner and outer surfaces, such that a portion of the anchor has a semicircular cross-section with respect to the longitudinal axis.

19. The adapter of claim 18, further comprising the inner surface of the anchor having an adjustable diameter by adjusting a width of the gap.

20. The adapter of claim 19, further comprising the anchor attaching to the firearm barrel via the fastener extending through a fastener aperture on one side of the gap and extending into a threaded fastener receipt on a second side of the gap, such that tightening the fastener causes the open barrel receiving area to reduce in size.

* * * * *